US009169065B2

(12) United States Patent
Speed

(10) Patent No.: US 9,169,065 B2
(45) Date of Patent: Oct. 27, 2015

(54) CONTAINER LID LATCH

(71) Applicant: Speed Eco Products and Systems Ltd., Lunenburg (CA)

(72) Inventor: Paul G. Speed, Wolfville (CA)

(73) Assignee: Speed Eco Products and Systems Ltd., Lunenbury, Nova Scotia (CA)

( * ) Notice: Subject to any disclaimer, the term of this patent is extended or adjusted under 35 U.S.C. 154(b) by 0 days.

(21) Appl. No.: 14/150,470

(22) Filed: Jan. 8, 2014

(65) Prior Publication Data

US 2014/0190982 A1 Jul. 10, 2014

Related U.S. Application Data

(60) Provisional application No. 61/750,589, filed on Jan. 9, 2013.

(51) Int. Cl.

| | |
|---|---|
| ***B65F 1/14*** | (2006.01) |
| ***B65D 45/22*** | (2006.01) |
| ***B65D 55/12*** | (2006.01) |
| *B65F 1/16* | (2006.01) |
| *B65D 45/28* | (2006.01) |
| *B65F 3/02* | (2006.01) |
| *B65D 45/16* | (2006.01) |
| *B65D 43/26* | (2006.01) |

(52) U.S. Cl.

CPC ..... *B65F 1/1615* (2013.01); *B65D 45/22* (2013.01); *B65D 55/12* (2013.01); *B65D 43/265* (2013.01); *B65D 45/16* (2013.01); *B65D 45/28* (2013.01); *B65F 1/1473* (2013.01); *B65F 2001/1676* (2013.01); *B65F 2003/023* (2013.01); *B65F 2210/148* (2013.01); *B65F 2250/114* (2013.01)

(58) Field of Classification Search

CPC ..... B65F 2001/1676; B65F 1/1623; B65F 1/1615; B65F 1/16; B65D 48/22; B65D 45/28; B65D 45/22; B65D 45/16; B65D 55/12

USPC ..... 220/833, 784, 730, 326, 323, 324, 315; 292/DIG. 38, DIG. 11, 87, 194, 1; 215/209; 206/1.5

See application file for complete search history.

(56) References Cited

U.S. PATENT DOCUMENTS

| | | | | |
|---|---|---|---|---|
| 2,873,880 | A * | 2/1959 | Poulos | 220/318 |
| 3,104,903 | A * | 9/1963 | Futch | 292/87 |
| 3,144,166 | A * | 8/1964 | Cross, Jr. et al. | 220/326 |
| 4,085,858 | A | 4/1978 | Smith | |
| 4,091,944 | A | 5/1978 | Gollnick | |
| 4,155,584 | A | 5/1979 | Pracchia | |
| 4,261,479 | A * | 4/1981 | Caserta | 220/326 |
| 4,270,668 | A | 6/1981 | Berfield | |

(Continued)

*Primary Examiner* — Steven A. Reynolds
*Assistant Examiner* — Mollie Llewellyn
(74) *Attorney, Agent, or Firm* — Kagan Binder, PLLC.

(57) ABSTRACT

The present invention is a latching mechanism and a container employing that latching mechanism, where the container has a lid that is attached to the rear of the container and can be rotated upward from the front. The latch includes an arm that attaches to the walls of the container with a protrusion extending above and abutting a portion of the top of the lid to latch it in place. The latch includes an arm abutment attached to the container above the arm attachment point so that when inward force is applied to the container below the arm, the arm rotates about the arm abutment causing the protrusion to no longer abut the lid, so that the lid can be opened. Such pressure may be applied by lifting arms attached to a garbage truck.

12 Claims, 3 Drawing Sheets

(56) References Cited

U.S. PATENT DOCUMENTS

| | | | | |
|---|---|---|---|---|
| 4,863,053 | A | 9/1989 | Oberg | |
| 5,015,143 | A | 5/1991 | Carson | |
| 5,050,762 | A | 9/1991 | Giorgi | |
| 5,071,307 | A | 12/1991 | Carson | |
| 5,094,487 | A | 3/1992 | Drewry | |
| 5,348,356 | A * | 9/1994 | Moulton | 292/80 |
| 5,755,547 | A | 5/1998 | Flerchinger et al. | |
| 6,808,080 | B2 | 10/2004 | Spiers et al. | |
| 7,413,096 | B2 * | 8/2008 | Morgan et al. | 220/254.9 |
| 2009/0134164 | A1 | 5/2009 | Henkel | |
| 2010/0090428 | A1 | 4/2010 | Meers et al. | |
| 2011/0272953 | A1 | 11/2011 | Mercier et al. | |
| 2011/0274525 | A1 | 11/2011 | Mercier et al. | |

* cited by examiner

CONTAINER LID LATCH

PRIORITY CLAIM

The present non provisional patent Application claims priority under 35 USC §119(e) from U.S. Provisional Patent Application having Ser. No. 61/750,589, filed Jan. 9, 2013, entitled "CONTAINER LID LATCH," the entirety of which is incorporated herein by reference in its entirety.

FIELD OF THE INVENTION

The present invention relates generally to latching mechanisms for latching a lid to the body of a container, where the latch can be released by applying inward pressure to the walls of the container.

BACKGROUND OF THE INVENTION

Containers formed from injection molded plastic are widely used for storage and disposal of solid and liquid materials. Such containers generally have a body having a base portion and a set of walls, together defining an interior space for storage of material, with an opening defined by the top edges of the walls. The base may be flat or curved. The walls may have various configurations. The walls generally extend vertically upward from the base, sometimes at an angle so that the horizontal cross-sectional area increases from the base to the top. The horizontal cross-section may be circular or oval, or may be closer to rectangular or square, although generally with the corners being smoothed.

In order to prevent animals from getting at the material stored in the interior region, such containers generally have a lid that is configured to cover and seal the opening. A simple lid may use a friction fit to attach it to the upper edges of the walls. In some cases the lid may be attached to the rear of the walls by a mechanism that allows the lid to rotate about the attachment point so it can move from a closed position in which the opening is sealed to an open position in which the lid is detached from the walls and the lid is substantially spaced apart from the front portion of the walls.

In many areas, a friction fit lid is not sufficient to protect the contents from animals, such as raccoons. Various latching mechanisms have been disclosed to provide a better solution. However, most require a concerted effort by a person in order to unlock the lid. While this is fine for the person putting trash into the container, in some cases it is desirable to use automated systems to pick up the material in the container. Such systems typically employ a pair of lifting arms that extend from a garbage truck and partially surround and squeeze the walls of the container on opposing sides. By squeezing with sufficient force, the arms can hold the container firmly, and the system can automatically lift the container, turning it over and dumping the contents into the truck—as long as the lid is not latched or otherwise held closed. When normal latched containers are used, the driver, or a second person, must get out of the truck and unlatch the lid before the lifting arms grab the container, thus increasing the time and cost for garbage pickup.

Some approaches to addressing this problem have been disclosed but they are complex and expensive and are generally only feasible for industrial scale waste management. For example, locks that automatically unlock due to the force of gravity when the container has been inverted have been disclosed. These are expensive, and also tend to be difficult for a person to use manually when putting trash into the container. Another approach uses a customized container and lifting arms, where the container has a latch on the front side, and the lifting arm has a special mechanism that moves in a predefined manner while the container is being picked up specifically in order to open the latch. This is an expensive approach. It would be much preferable to provide a design that allows existing lifting arms to automatically unlatch the lid.

SUMMARY OF THE INVENTION

The following presents a simplified summary of the disclosure in order to provide a basic understanding to the reader. This summary is not an extensive overview of the disclosure and it does not necessarily identify key/critical elements of the invention or delineate the scope of the invention. Its sole purpose is to present some concepts disclosed herein in a simplified form as a prelude to the more detailed description that is presented later.

The present invention provides a lid latch for attachment to a container. The container has a lid and a body, with the body comprising a base portion and walls defining an interior region for receiving and retaining material. The body has opposed rear and front sides and a vertical central axis. The walls have an upper edge that defines an opening to the interior region. The lid is rotatably attached to the rear portion of the body so that it can be rotated from a closed position, in which the opening is sealed by the lid, to an open position to expose the opening. The lid has an upper surface. The lid latch includes an arm, an arm abutment and a protrusion. The arm has a lower end for attachment to an outer portion of the walls at an arm attachment point that is horizontally spaced apart from the rear portion of the walls. The arm abutment is made from substantially rigid material and is attached to an outer portion of the walls above the arm attachment point. The arm abutment has an outer surface abutting a portion of the arm at a horizontal distance from the central axis that is greater than the horizontal distance of the arm attachment point from the central axis. The protrusion is attached to the arm and extends from the arm above the abutment, towards the vertical axis, sufficiently far so that, when the lid is in the closed position and the body is not subjected to external forces, a portion of the protrusion is above and abuts a portion of the upper surface of the lid, preventing the lid from being moved into an open position. The walls are flexible so that they may be brought closer to the vertical axis by applying external force inward towards the vertical axis below the attachment point, thereby causing the arm attachment point to move closer to the vertical axis by more than the abutment outer surface. This causes the arm to rotate about the abutment, which acts as a fulcrum, resulting in the protrusion moving further from the vertical axis so that no portion of the protrusion is above the top surface of the lid and the lid may then be opened.

The arm may be rotatably attached to the walls so that the arm may rotate towards the rear portion of the walls. The lid may have a protrusion abutment that is the portion of the upper surface of the lid that abuts the protrusion in a closed position. The protrusion abutment may extend outward from other portions of the lid so that the portion of the upper surface of the lid that abuts the protrusion in a closed position is farther from the vertical axis than any other portions of the lid near the protrusion abutment, but does not extend towards the rear portion of the walls substantially beyond the portion that abuts the protrusion, so that a user may push the arm, rotating it towards the rear portion of the walls, causing the protrusion to no longer abut the lid, allowing the lid to be opened.

The arm may be rigid and substantially straight. The protrusion may be "V" shaped or triangular.

The present invention also provides a container including a body, a lid and a lid latch as described above. The body has a base portion and walls defining an interior region for receiving and retaining material. The body has opposed rear and front sides and a vertical central axis. The walls have an upper edge defining an opening to the interior region. The lid is rotatably attached to the rear portion of the body so that it can be rotated from a closed position, in which the opening is scaled, to an open position to expose the opening.

The container may further comprise a second lid latch, being the lid latch described above, where the first and second lid latches are disposed on opposite sides of the walls. The arm abutments of the first and second lid latches may be integrally formed with the walls of the container.

The invention further provides a lid latch for attachment to a container. The container has a lid and a body. The body defines an interior region with an opening for receiving and retaining material. The body has a vertical central axis. The lid is rotatably attached to the body at a lid attachment portion of the body so that the lid can be rotated from a closed position, in which the opening is sealed by the lid, to an open position to expose the opening. The lid latch includes an arm, an arm abutment and a protrusion. The arm has a lower end for attachment to an outer portion of the body at an arm attachment point that is horizontally spaced apart from the lid attachment portion of the body. The arm abutment is made from substantially rigid material and is attached to an outer portion of the body above the arm attachment point. The arm abutment abuts a portion of the arm above the arm attachment point. The protrusion is attached to the arm and extends from the arm at a point above the abutment and extends towards the vertical axis sufficiently far so that, when the lid is in the closed position and the body is not subjected to external forces, a portion of the protrusion is above and abuts a portion of the lid, preventing the lid from being moved into an open position. The body is flexible so that by applying external force to the body inward towards the vertical axis below the attachment point, the arm attachment point moves closer to the vertical axis by more than the abutment moves, causing the arm to rotate about the abutment, which acts as a fulcrum, resulting in the protrusion moving further from the vertical axis so that no portion of the protrusion is above the lid and the lid may then be opened.

DETAILED DESCRIPTION OF THE INVENTION

Figure 1:
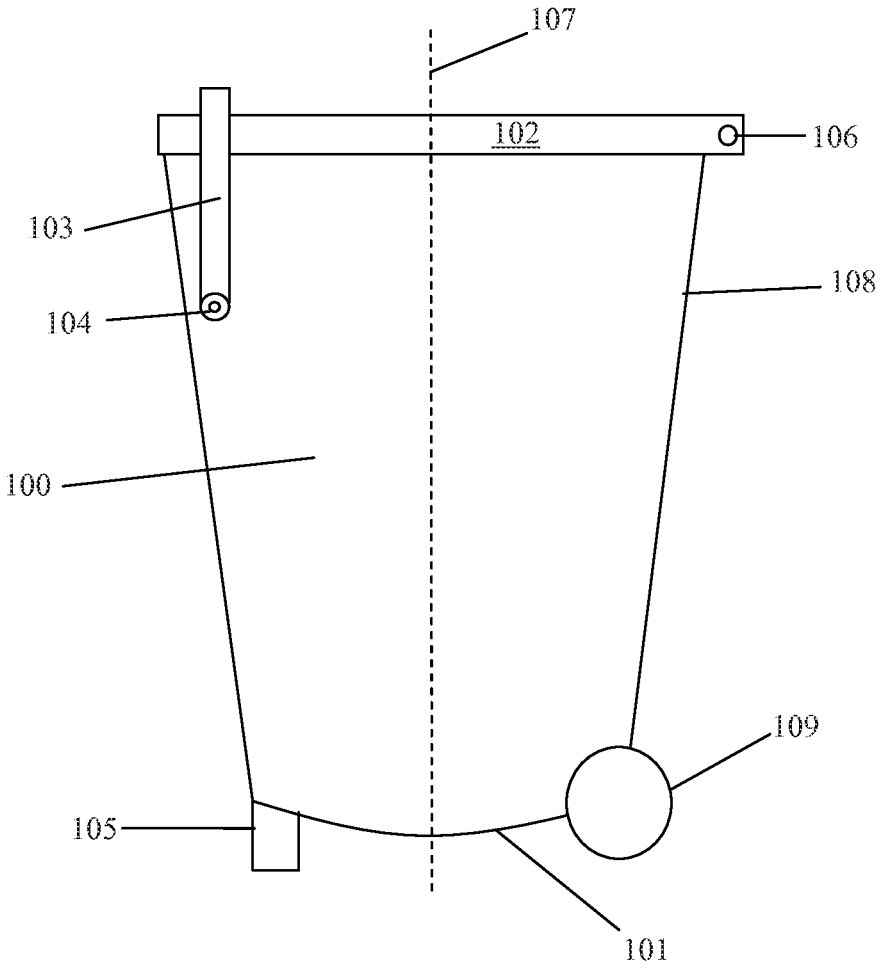
FIG. 1 is a side view of a container with a lid latched to the walls of the container.
Figure 3:
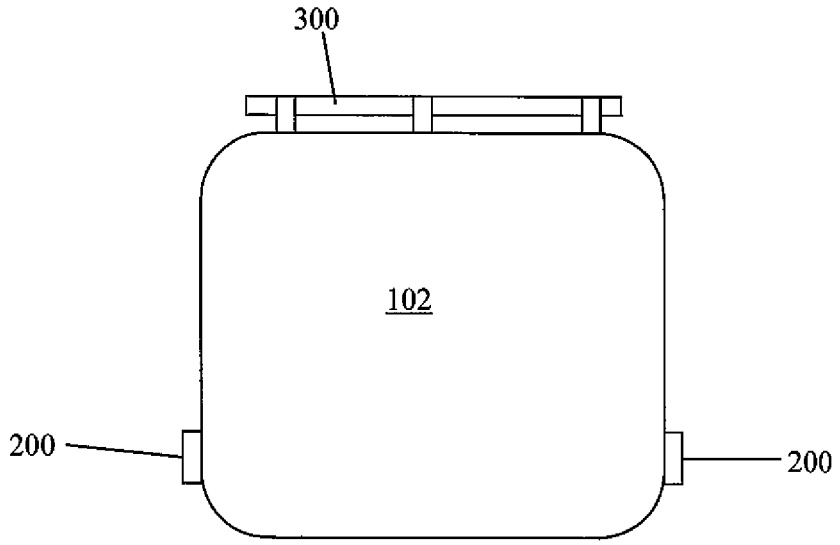
FIG. 3 is a top plan view of a lid of a container having two protrusion abutments.

FIG. 1 is a side view of a container with a lid 102, employing an embodiment of the latching mechanism. The container comprises a curved base 101 and walls 100 forming an interior space, the depicted embodiment may have a horizontal cross section, like that seen in the top view of FIG. 3, that is generally rectangular with smoothed corners. The container may have wheels 109 and a front piece 105 so that it rests stably on flat ground. In the depicted embodiment of FIG. 1, the lid 102 is rotatably connected to the rear portion 108 of the walls 100 by an axle 106 that allows the front of the lid, when unlatched, to be rotated upward about the axle 106 to expose the opening and the contents of the interior space. The container has a vertical axis 107, which is depicted as a dashed line. Generally the walls 100 are further from the vertical axis 107 as the height increases. This is not essential, but can make it easier to empty and clean the container.

Generally, the container is considered to have rear and front portions, the rear portion being the side where the wheels, if any, and lid axle 106 are attached, and the front being the opposite side from which a user would normally open the container. The other two sides can be referred to as left and right, although in the case of a container with a circular cross-section these terms are less distinct, but are still meaningful and useful.

Figure 2:
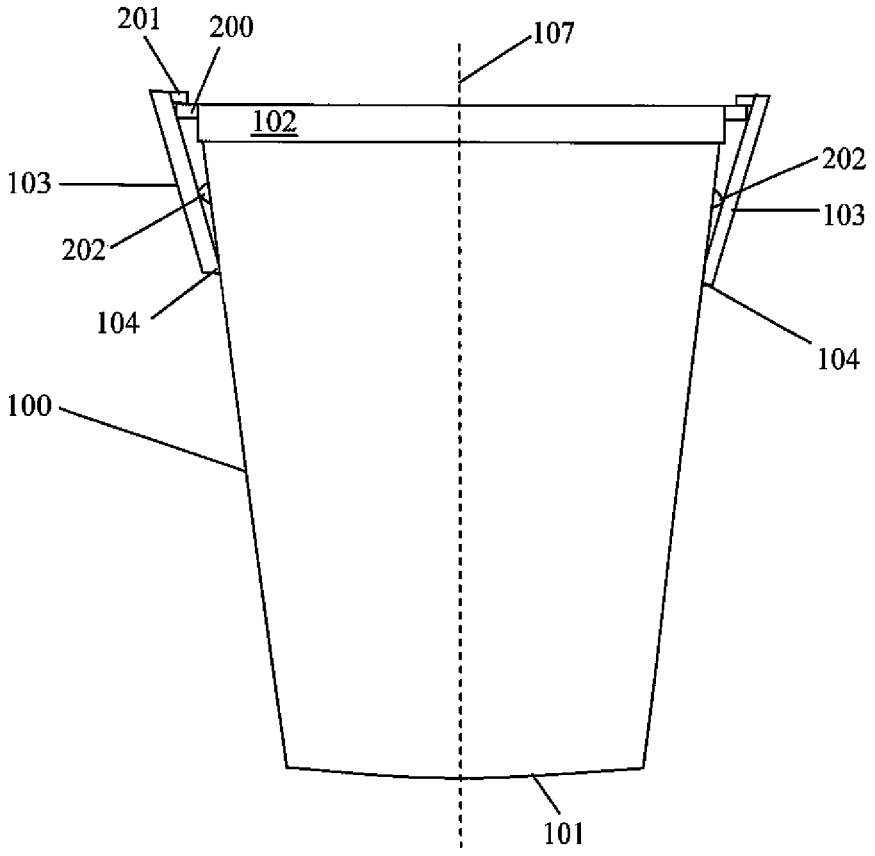
FIG. 2 is a front view of a container with a lid latched to the walls of the container.

In FIGS. 1 and 2, the lid 102 is in the closed and latched position so that the lid 102 seals the opening to the interior of the container. The lid 102 is latched in FIGS. 1 and 2 by two latching mechanisms. Each latching mechanism includes an arm 103 that is attached to an outer portion of the walls 100 at an arm attachment point 104 that is spaced apart from the rear portion 108 of the walls and is at a distance referred to as "DAP", for Distance from Attachment Point, from the vertical axis 107. In the case of a rectangular embodiment, rather than an axis, it is preferable to think in terms of a central plane that passes through the axis and is equidistant between the side walls, so that DAP is the perpendicular distance to the central plane. References to a central or vertical axis in such embodiments should be considered to be equivalent to references to such a central plane or, alternatively, the central axis should be understood to be an axis through the center of the container (in terms of left-right) but positioned closest to the point to which the distance is being measured in terms of front-back position.

Another element of the latching mechanism is an arm abutment 202, shown in FIG. 2, which is made from substantially rigid material and attached to the outer portion of the walls 100 above the arm attachment point 104. The arm abutment 202 may be integrally formed with the walls 100 or otherwise attached thereto. For example it could be a ring with uniformly increased distance from the vertical axis 107 relative to the neighboring portions of the walls 100. The arm abutment 202 has an outer surface at a maximal distance DA from the axis 107, where DA is greater than DAP. As seen in FIG. 2, the arm abutment 202 abuts a portion of the arm 103 above the arm attachment point 104.

Figure 5:
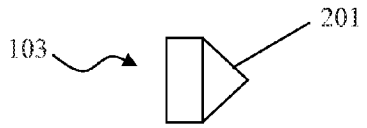
FIG. 5 is a top plan view of an embodiment of an arm having a protrusion that is "V" shaped or triangular.

The final element of the latching mechanism is a protrusion 201 attached to the arm 103 extending from the arm 103 above the arm abutment 202 and extending towards the vertical axis 107 sufficiently far so that, when the lid 102 is in the closed position and the lid 102 is not subjected to external forces, a portion of the protrusion 201 is above and abuts a portion 200 (the "protrusion abutment") of the upper surface of the lid 102, preventing the lid 102 from being moved into an open position. The protrusion 201 may be "V" shaped or triangular, as shown in FIG. 5.

The protrusion abutment 200 may be any outer portion of the top surface of the lid 102. However, as in the embodiment shown in FIG. 3, the protrusion abutment 200 preferably has a limited extent in the front-back direction. It extends outward from other portions of the lid 102, so that the portion of the upper surface of the lid 102 that abuts the protrusion 201 in a closed position is farther than any other portions of the lid 102 near the protrusion abutment 200, but does not extend towards the rear portion of the walls substantially beyond the portion that abuts the protrusion 201. The arm 103 may rotate about the attachment point 104 towards the rear portion 108 of the walls, e.g. by a user pushing it towards the rear, so that it loses contact with the protrusion abutment 200, leaving the lid 102 unlatched (after this is done to both arms 103) so that the lid 102 can be opened. The user can then put material into the container, close the lid 102, and latch it again by pulling each arm 103 towards the front until each protrusion 201 abuts the corresponding protrusion abutment 200.

Alternatively or additionally, the arm 103 may rotate about the attachment point 104 towards the front portion of the walls, e.g. by a user pulling it towards the front, so that it loses contact with the protrusion abutment 200, leaving the lid 102 unlatched (after this is done to both arms 103) so that the lid 102 can be opened. The user can then put material into the container, close the lid 102, and latch it again by pushing each arm 103 towards the back until each protrusion 201 abuts the corresponding protrusion abutment 200.

Figure 4:
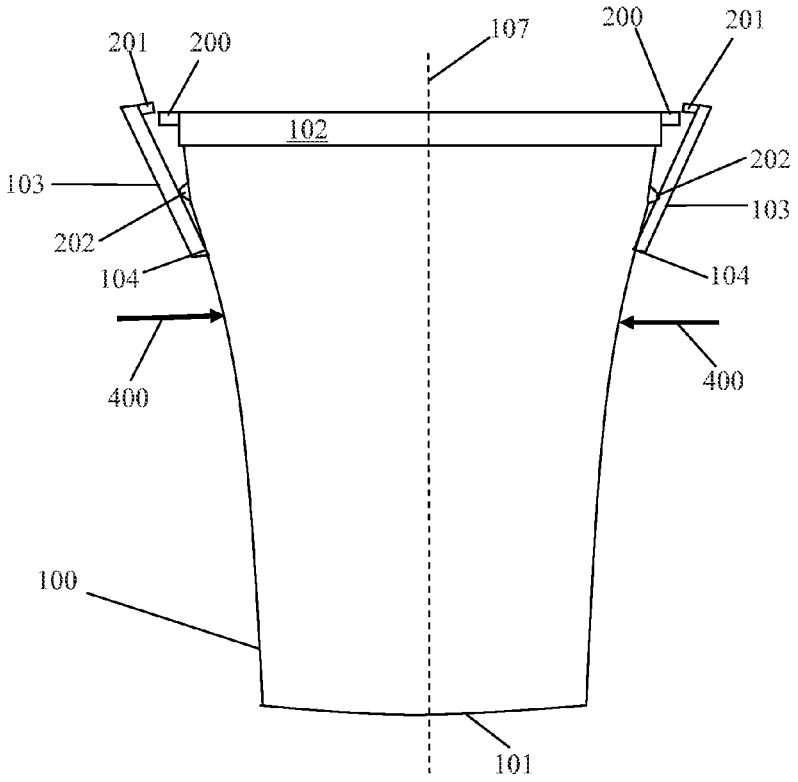
FIG. 4 is a front view of a container to which inward forces are being applied, causing the latch arms to rotate about the arm abutment so that the protrusions have lost contact with the protrusion abutments and the lid is unlatched.

The walls 100 are made of a firm but flexible material, typically injection molded plastic, which can be partly compressed by the lifting arms of a garbage truck lifting device. Such devices are designed to squeeze the walls 100 until a pre-determined amount of resistance is encountered. For example, FIG. 4 shows opposite forces 400 being applied towards the central axis 107, causing the walls 100 to bend inwards. However, the arm abutment points 202 are significantly further away from the force 400 than are the arm attachment points 104, and so the former move less towards the axis 107 than do the latter. This results in the arm abutment points 202 acting as fulcrums for the lever arms 103, resulting in the top part of the arms 103, including the protrusions 201, being moved significantly away from the central axis 107. By choosing appropriate sizes of the various components, the arms 103 can readily be configured so that, as shown in FIG. 4, when a normal lifting arm force 400 is applied to the sides, the protrusion 201 is moved outward beyond the outermost part of the protrusion abutment 200, leaving the lid 102 unlatched, so that when it is turned upside down, the lid 102 will fall open.

The walls above the arm abutment points 202 may be reinforced to minimize any movement of the arm abutment points 202 towards the central axis 107 when the walls 100 are squeezed inwardly below the arm attachment point 104.

As shown in the embodiment depicted in FIGS. 2 and 4, it is preferred that the container have a lid latch on each of the left and right opposing sides of the walls 100. In the case of a container with a circular cross section, the latches are preferably placed 180 degrees away from each other on the left and right sides of the walls, at the points equidistant between the front and rear of the container. In the case of a container with an approximately rectangular or square cross section, it is generally preferred that the latches be placed on the left and right sides nearer to the front side of the container, but before the position, if any, on the left and right sides that the walls become rounded. However, it is only necessary that the latches be spaced apart from the rear portion of the walls so that when they are latched, the front of the lid 102 is prevented from being raised to open the lid 102.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are to used to specify the presence of stated features, elements, integers, steps or components, and do not preclude, nor imply the necessity for, the presence or addition of one or more other features, elements, integers, steps, components or groups thereof.

The scope of the claims that follow is not limited by the embodiments set forth in the description. The claims should be given the broadest purposive construction consistent with the description as a whole.

What is claimed is:

1. A lid latch assembly for use to latch the lid of a container, the container having a lid and a body, the body comprising a base portion and walls defining an interior region for receiving and retaining material, the body having opposed rear and front sides and a vertical central axis, the walls having an upper edge defining an opening to the interior region, the lid being rotatably attached to the rear portion of the body so that it can be rotated from a closed position, in which the opening is sealed by the lid, to an open position to expose the opening, the lid having an upper surface, the lid latch assembly comprising:

(a) the walls of the container;

(b) an arm having a lower end attached to outer portion of the walls at an arm attachment point that is horizontally spaced apart from the rear portion of the walls;

(c) an arm abutment made from substantially rigid material and attached to an outer portion of the walls above the arm attachment point, the arm abutment having an outer surface abutting a portion of the arm at a horizontal distance from the central axis that is greater than the horizontal distance of the arm attachment point from the central axis; and (d) a protrusion attached to the arm extending from the arm above the arm abutment and extending towards the vertical axis sufficiently far so that when the lid is in the closed position and the body is not subjected to external forces, a portion of the protrusion is above and abuts a portion of the upper surface of the lid, preventing the lid from being moved into an open position, wherein the walls are flexible so that they may be brought closer to the vertical axis by applying external force inward towards the vertical axis below the attachment point, thereby causing the arm attachment point to move closer to the vertical axis by more than the arm abutment outer surface, causing the arm to rotate about the arm abutment, which acts as a fulcrum, resulting in the protrusion moving further from the vertical axis so that no portion of the protrusion is above the top surface of the lid and the lid may then be opened.

2. The lid latch assembly of claim 1, wherein the arm is rotatably attached to the walls so that the arm may rotate towards the rear portion of the walls, and the lid comprises a protrusion abutment comprising the portion of the upper surface of the lid that abuts the protrusion in a closed position, and the protrusion abutment extends outward from other portions of the lid so that the portion of the upper surface of the lid that abuts the protrusion in a closed position is farther from the vertical axis than any other portions of the lid near the protrusion abutment, but does not extend towards the rear portion of the walls substantially beyond the portion that abuts the protrusion, so that a user may push the arm, rotating it towards the rear portion of the walls, causing the protrusion to no longer abut the lid, allowing the lid to be opened.

3. The lid latch assembly of claim 1, wherein the arm is rigid and substantially straight.

4. The lid latch assembly of claim 1, wherein the protrusion is "V" shaped or triangular.

5. A container comprising:

(a) a body comprising a base portion and walls defining an interior region for receiving and retaining material, the body having opposed rear and front sides and a vertical central axis, the walls having an upper edge defining an opening to the interior region;

(b) a lid rotatably attached to the rear portion of the body so that it can be rotated from a closed position, in which the opening is sealed, to an open position to expose the opening, the lid having an upper surface; and (c) a first lid latch comprising:

(i) an arm having a lower end attached to an outer portion of the walls at an arm attachment point that is horizontally spaced apart from the rear portion of the walls;

(ii) an arm abutment made front substantial rigid material and attached to an outer portion of the walls above the arm attachment point, the arm abutment having an outer surface abutting a portion of the arm at a horizontal distance from the central axis that is greater than the horizontal distance of the arm attachment point front the central axis; and (iii) a protrusion attached to the arm extending from the arm above the arm abutment and extending towards the vertical axis sufficiently far so that, when the lid is in the closed position and the body is not subjected to external forces, a portion of the protrusion is above and abuts a portion of the upper surface of the lid, preventing the lid from being moved into an open position, wherein the walls are flexible so that they may be brought closer to the vertical axis by applying external force inward towards the vertical axis below the attachment point, thereby causing the arm attachment point to move closer to the vertical axis by more than the arm abutment outer surface, causing the arm to rotate about the arm abutment, which acts as a fulcrum, resulting in the protrusion moving further from the vertical axis so that no portion of the protrusion is above the top surface of the lid and the lid may then be opened.

6. The container of claim 5, further comprising a second lid latch according to claim 1, wherein the first and second lid latches are disposed on opposite sides of the body.

7. The container of claim 6, wherein the arm abutments of the first and second lid latches are integrally formed with the walls of the container.

8. A lid latch assembly for use to latch the lid of a container, the container having a lid and a body, the body defining an interior region with an opening for receiving and retaining material, the body having a vertical central axis, the being rotatably attached to the body at a lid attachment portion of the body so that the lid can be rotated from a closed position, in which the opening is sealed by the lid, to an open position to expose the opening, the lid latch assembly comprising:

(a) the body of the container;

(b) an arm having a lower end for attachment to an outer portion of the body at an arm attachment point that is horizontally spaced apart from the lid attachment portion;

(c) an arm abutment made from substantially rigid material and attached to an outer portion of the body above the arm attachment point, the arm abutment abutting a portion of the arm above the arm attachment point; and (d) a protrusion attached to the arm, the protrusion extending from the arm at a point above the arm abutment and extending towards the vertical axis sufficiently far so that, when the lid is in the closed position and the body is not subjected to external forces, a portion of the protrusion is above and abuts a portion of the lid, preventing the lid from being moved into an open position, wherein the body is flexible so that by applying external force to the body inward towards the vertical axis below the attachment point, the arm attachment point moves closer to the vertical axis by more than the arm abutment moves, causing the arm to rotate about the arm abutment, which acts as a fulcrum, resulting in the protrusion moving further from the vertical axis so that no portion of the protrusion is above the lid and the lid may then be opened.

9. The lid latch assembly of claim 8, wherein the arm is rotatably attached to the body so that the arm may rotate, and the lid comprises a protrusion abutment comprising the portion of the lid that abuts the protrusion in a closed position, and the protrusion abutment extends outward from other portions of the lid so that the portion of the lid that abuts the protrusion in a closed position is farther from the vertical axis than any other portions of the lid near the protrusion abutment, so that a user may push the arm, causing the arm to rotate so that the protrusion no longer abuts the lid, allowing the lid to be opened.

10. The lid latch of claim 9, wherein the horizontal distance from the vertical axis to the portion of the arm abutment that abuts the arm is greater than the horizontal distance from the vertical axis to the arm attachment point.

11. The lid latch assembly of claim 10, wherein the arm is rigid and substantially straight.

12. The lid latch assembly of claim 10, wherein the protrusion is "V" shaped or triangular.

* * * * *

UNITED STATES PATENT AND TRADEMARK OFFICE

CERTIFICATE OF CORRECTION

PATENT NO. : 9,169,065 B2
APPLICATION NO. : 14/150470
DATED : October 27, 2015
INVENTOR(S) : Paul G. Speed It is certified that error appears in the above-identified patent and that said Letters Patent is hereby corrected as shown below:

Claim 8,
Column 8, line 7, "having a vertical central axis, the being" should be -- having a vertical central axis, the lid being --

Signed and Sealed this
First Day of March, 2016

Michelle K. Lee

Michelle K. Lee
*Director of the United States Patent and Trademark Office*